US006172695B1

(12) United States Patent
Liu

(10) Patent No.: US 6,172,695 B1
(45) Date of Patent: Jan. 9, 2001

(54) INK REPLENISHING DEVICE FOR LINK CARTRIDGE OF A JET PRINTER

(76) Inventor: Win-Yin Liu, P.O. Box 96-405, Taipei 106 (TW)

( * ) Notice: Under 35 U.S.C. 154(b), the term of this patent shall be extended for 0 days.

(21) Appl. No.: 09/236,095

(22) Filed: Jan. 25, 1999

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS 5,329,294 * 7/1994 Ontawar et al. ..... 347/87
5,510,820 * 4/1996 Aulick et al. ..... 347/85
5,515,663 * 5/1996 Allgeier, Sr. et al. ..... 53/467
5,706,870 * 1/1998 Maerzke ..... 141/18
5,883,652 * 3/1999 Moser et al. ..... 347/85

* cited by examiner

*Primary Examiner*—N. Lee
*Assistant Examiner*—Anh T. N. Vo
(74) *Attorney, Agent, or Firm*—Dougherty & Troxell

(57) ABSTRACT

An ink replenishing device for an ink cartridge of a jet printer, of which the body part of the ink cartridge has a storage chamber, loaded with a sponge for soaking ink and balancing the pressure in the storage chamber. After the ink in the storage chamber is used up, the output port of the ink cartridge is closed with a glue paper so as to protect the resilient pad on the inner surface on the supporting plate and to seal the output port of the ink cartridge. A membrane attached on the through hole of the top surface of the ink cartridge is stabbed through by a short taper-shaped ink straw on the ink bottle so as to have the ink straw and the through hole connected together hermetically. The ink bottle is squeezed repeatedly so as to have the ink and the air in the ink cartridge exchanged in a convection manner via the ink straw, and to complete the ink-replenishing operation quickly.

6 Claims, 12 Drawing Sheets

INK REPLENISHING DEVICE FOR LINK CARTRIDGE OF A JET PRINTER

BACKGROUND OF THE INVENTION

1. Field of the Invention

This invention relates to an ink cartridge of a jet printer, and particularly to an ink-replenishing device for ink cartridge of a jet printer.

2. Description of the Prior Art

In the conventional jet printer, the ink is loaded in a cartridge, and the ink jetted on the printing paper is controlled with a sparager; when ink in the cartridge is used up, the cartridge has to be replaced for further printing operation; however, the ink cartridge supplied by the original manufacturer is considerably expensive, i.e., a user to print a lot of papers will spend a lot of money.

In the conventional ink cartridge of a jet printer, the ink chamber of the ink cartridge is usually loaded with an equalization air bladder or a piece of sponge for soaking and supplying ink. The ink cartridge supplied by the original manufacturer usually has an equal pressure in the ink chamber during the automatic manufacturing process, and there will be no leak during printing operation.

When refilling ink into a conventional hollow ink cartridge, and if such ink cartridge is furnished with an equalization air-bladder in the ink chamber thereof, a sticky tape should be used to close the air vent of the maze passage on the bottom of the ink cartridge so as to prevent ink from leaking; then, the intake hole of the air-bladder should also be closed with sticky tape so as to maintain equalization of pressure; then, using a sharp point to press the seal bead out of its position so as to provide a refilling hole. Take a suitable amount of ink with a syringe, and then inject the ink into the refilling hole in the ink cartridge slowly until the cartridge is full; use a rubber plug to seal the refilling hole, and then tear off the sticky tapes on the intake hole and on the bottom of the ink cartridge respectively; it is quite often that the opening end of the maze passage or the jet nozzle will have a leakage of ink after the sticky tape on the bottom of cartridge is removed because of the pressure in the ink chamber not being equalized. To overcome such leakage, the only method is to rub off the ink leaked slowly until the leak stops.

In the conventional ink cartridge loaded with a sponge, an empty ink cartridge can be replenished by sealing and closing the end opening of the output port by means of a glue paper; then, a center through hole on a lid of the top surface of the ink cartridge is sealed with a membrane; a syringe is sucked with a suitable amount of ink. A slender hollow needle is used to stab through the membrane on the through hole, and to the most lower portion of the storage chamber so as to inject ink in the storage chamber; however, the sponge in the storage chamber contains a great amount of bubbles, and the ink injected is unable to exhaust the air therein; as a result, the ink injected in is limited. Since there is a mesh furnished between the storage chamber and the second chamber, if air in the second chamber is unable to exhaust, the ink in the storage chamber will be unable to enter the second chamber via the mesh, and the ink will be unable to flow into the spraying chamber.

In order to prevent the glue paper on the output port from leaking ink, a C-shaped clamp is used to grip a resilient pad on the inner surface of the lower support plate. The upper support plate of the clamp is shorter one. The clamp and the ink cartridge are gripped together; by means of the resilient pad on the lower support plate, the output port would not leak; however, the C-shaped clamp is to be mounted in place by pushing and squeezing, and therefore it can not provide a firm gripping; then, the resilient pad is unable to attach to the outer surface of the output port flat, i.e., leakage can not be prevented completely.

To use a balance air bag or a sponge for balancing the pressure in the storage chamber, the ink cartridge is usually furnished in the prime chamber; a second chamber is furnished between the prime chamber and the printing head. Between the two chambers, there is a fine mesh used for balancing the pressure difference thereof so as to have the ink flow evenly into the storage chamber of the sprayer in the printing head, and also to prevent impurities in the ink of prime chamber from entering the second chamber.

When the ink cartridge on a printer fails to print continuously, the major cause is that the sprayer in the printing head is in short supply of ink, i.e., lack of sufficient ink flowing through the passage defined by the bearing member; in other words, if too much air enters the second chamber in the printing head, such air would enter the storage chamber of the sprayer to cause interruption of ink, i.e., having no ink to spray out; in the event of no ink to spray out of the sprayer for a considerable time, the sprayer might be burned out.

SUMMARY OF THE INVENTION

The prime object of the present invention is to provide an ink-replenishing device for an ink cartridge, in which the body part of the ink cartridge in a printer is furnished with at least one storage chamber; the storage chamber is loaded with a sponge for soaking ink and balancing the pressure in the storage chamber. After ink in the storage chamber of the ink cartridge is used up, the end opening of the output port should be sealed hermetically; let the short taper-shaped ink straw contact closely with the through hole, and then squeeze the ink bottle so as to have ink injected into the storage chamber; as soon as the ink bottle is released, it will suck air so as to exhaust air in the sponge of the storage chamber.

Another object of the present invention is to provide an ink-replenishing device for an ink cartridge, in which a mesh is furnished between the storage chamber with a sponge therein and a second chamber nearing the output port; let the short taper-shaped ink straw contact closely with the through hole of the ink cartridge. When the ink straw sucks air into the ink bottle, air in the second chamber under the mesh will be exhausted, while ink will flow into the second chamber.

Still another object of the present invention is to provide an ink-replenishing device for ink cartridge, in which the ink straw on the front end of the ink bottle is designed to fit the diameter of the through hole on the top surface of every type of ink cartridge, and the ink straw is designed into a short taper-shaped member. The center of the short taper-shaped ink straw is furnished with an ink passage to facilitate convection between ink and air; the short taper-shaped ink straw and the ink hole of the ink cartridge are connected together closely, and then the ink bottle is squeezed so as to have ink injected into the storage chamber quickly. As soon as the ink bottle is released, the air sucked out will flow into the ink bottle quickly through the slender ink passage.

A further object of the present invention is to provide an ink-replenishing device for an ink cartridge, in which the end opening of the output port of the ink cartridge is attached with a glue paper; one side of the ink cartridge is mounted with a protection clamp by means of a clamp space thereof upon a pressing surface of the clamp being pressed downwards, and then the space between the supporting plate and the clamp plate will be increased to facilitate the ink cartridge to set in the clamp space; then, the resilient pad on the inner surface of the supporting plate will be in close contact with the end opening of the output port.

A still further object of the present invention is to provide an ink-replenishing device for an ink cartridge, in which the protection clamp mounted on the output port has a vertical plate, and both sides of the vertical plate are furnished with two supporting plates respectively. One side of the vertical plate has a clamp plate on an upper part thereof, while the other side thereof has a pressing plate. The upper part of the vertical plate has a neck portion connected with the upper plates; the neck portion enables the clamp plate to bend upwards upon pushing downwards the pressing plate so as to increase the height of the clamp space to facilitate the output port to be gripped therein.

DETAILED DESCRIPTION OF THE PREFERRED EMBODIMENT

Figure 1:
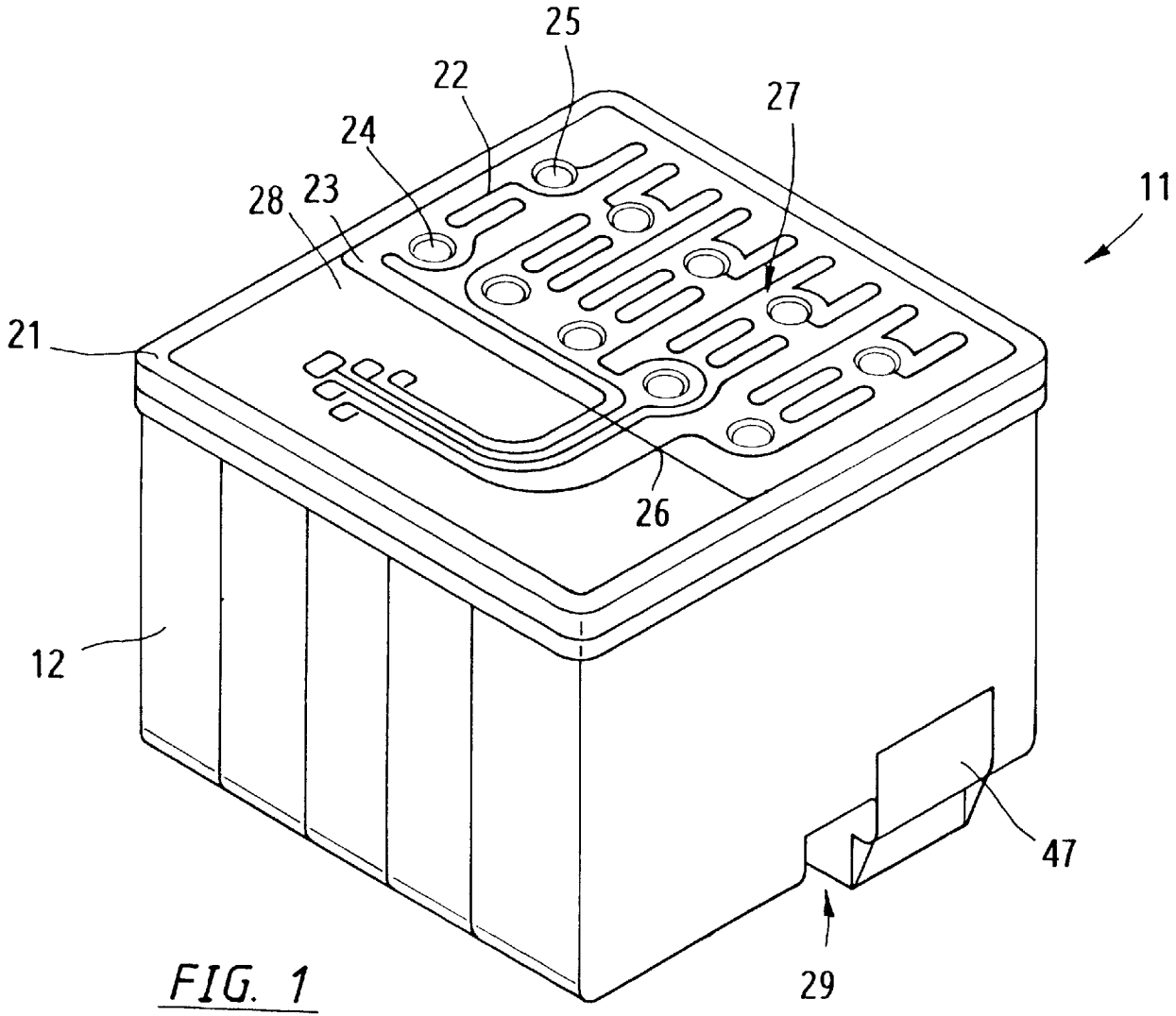
FIG. 1 is a perspective view of the ink cartridge according to the present invention.
Figure 2:
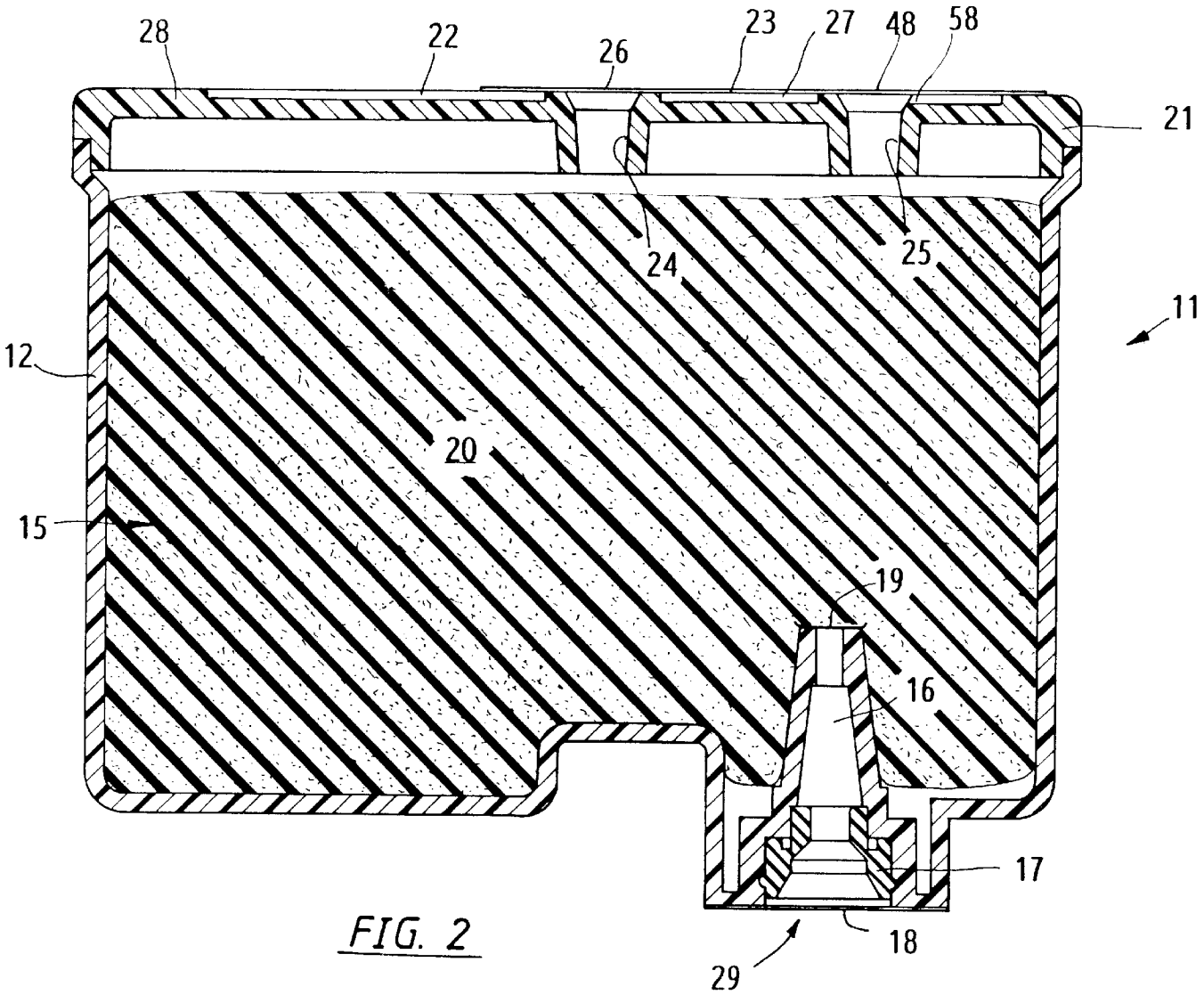
FIG. 2 is a sectional view of the ink cartridge, showing the inner structure thereof.
Figure 3:
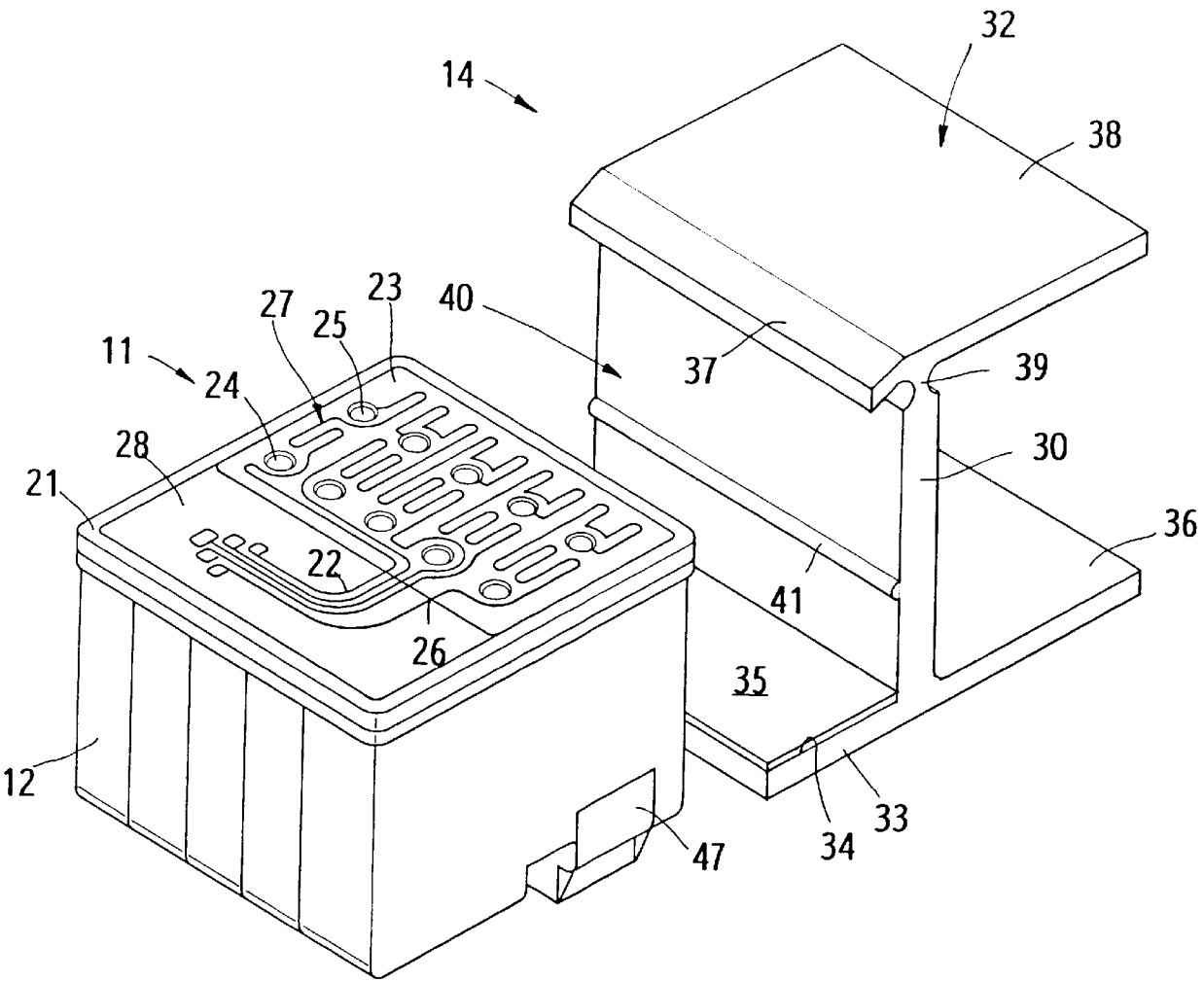
FIG. 3 is a disassembled view of the present invention, showing the relation among he parts of the replenishing device.
Figure 4:
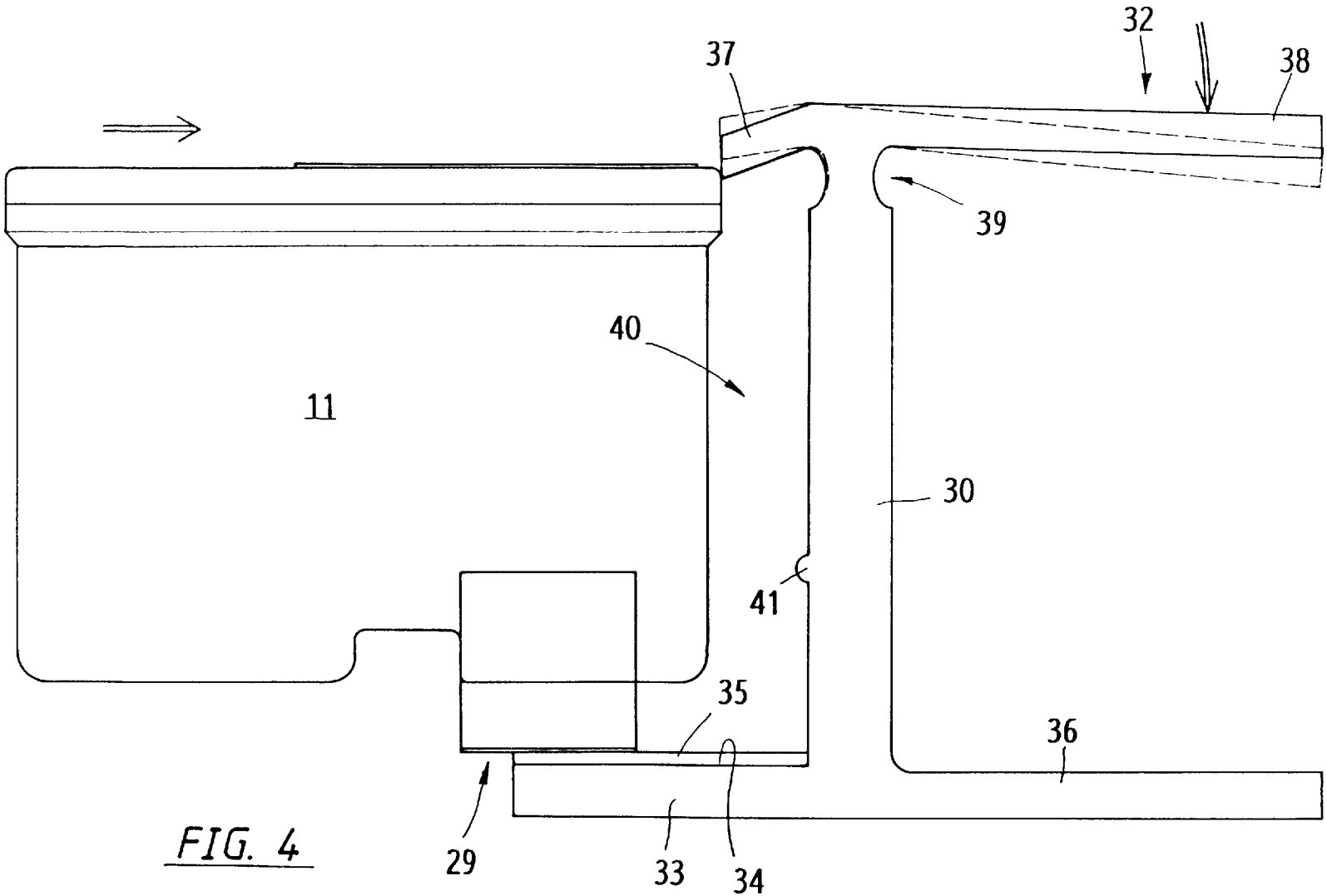
FIG. 4 is a side view of the present invention, showing the clamping relation between the ink cartridge and the protection clamp.
Figure 5:
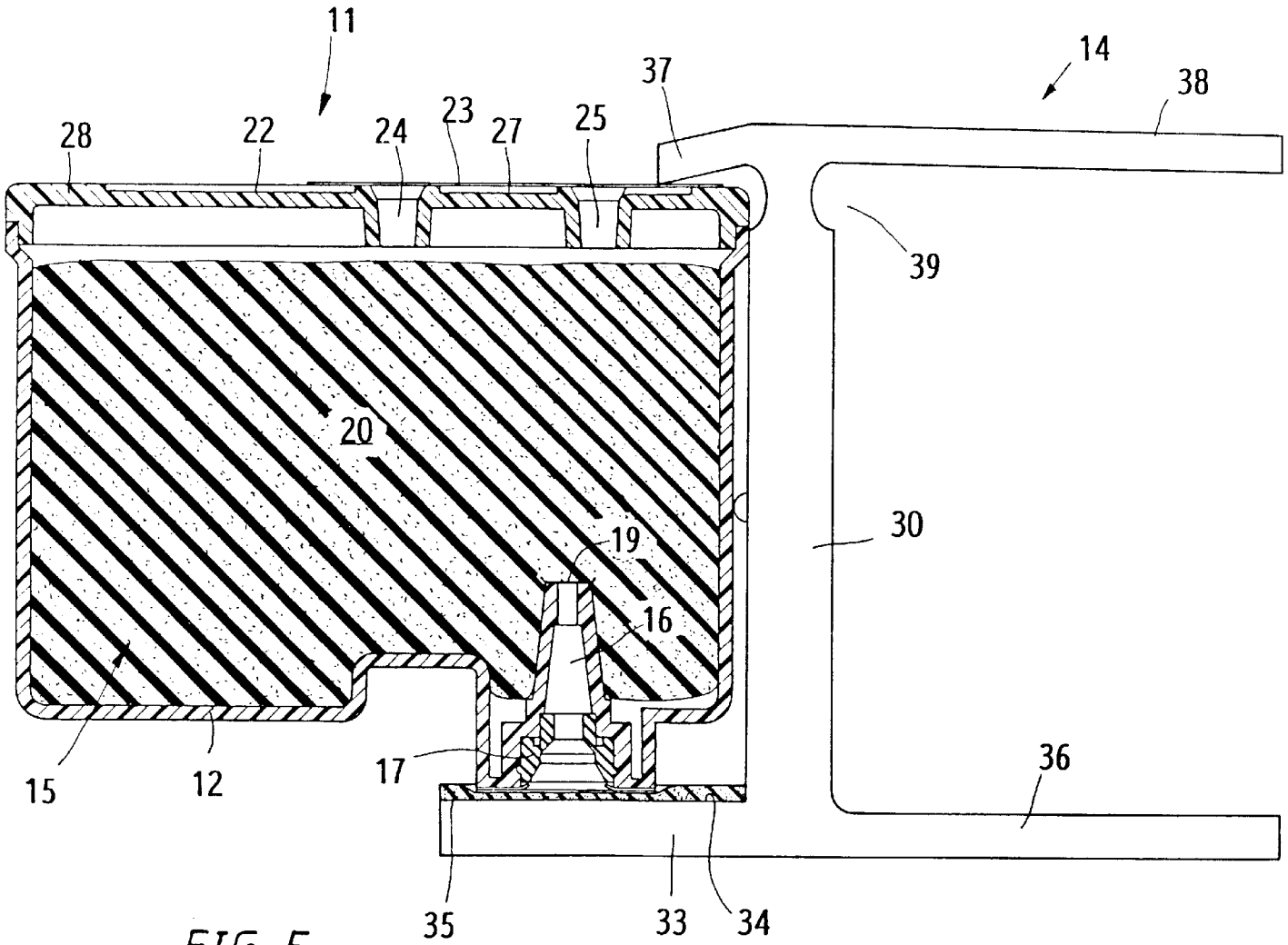
FIG. 5 is a sectional view of the present invention, showing the clamping relation between the ink cartridge and the protection clamp.

Referring to FIGS. 1 and 2, an EPSON ink cartridge (S020110/PMIC1C) of a color jet printer is shown therein; the inner space of the body part 12 of the ink cartridge 11 are partitioned into several isolated storage chambers 15 corresponding to ink colors as required; every storage chamber 15 is loaded with a sponge 20 for storing a color ink; the lower part of each storage chamber 15 has a mesh 19 to separate from the second chamber 16 so as to prevent impurities in the storage chamber 15 from entering the second chamber 16. The ink can flow from each storage chamber 15 into the second chamber 16 by means of siphon effect; the space in the second chamber 16 is not large. When assembling the ink cartridge 11, the output port 29 of the ink cartridge 11 for each second chamber 16 has a hermetic gasket 17; the mouth of the output port 29 is sealed with an isolation film 18; then, every storage chamber 15 is loaded with a sponge 20; the top of the body part 12 is closed with a lid 21, of which the top surface 28 is furnished with a given member of maze grooves 22 equal to that of the storage chambers 15. The tail end of each maze groove 22 has a through hole 25 in communication with the storage chamber 15 and another through hole 24 for replenishing ink. The top surface 28 of the lid 21 is furnished with two through holes 24 and 25 to facilitate refilling ink. The through hole 24 is plugged with a hollow needle extended into the sponge 20; the hollow needle and the through hole 24 are hermetically sealed together; one end of the through hole 25 is hermetically connected together with an independent end of a vacuum assembly. By means of the vacuum-pumping force of the vacuum assembly, ink can be sucked into the storage chamber 15 of the ink cartridge 11, and infiltrated quickly into the sponge 20; simultaneously, air inside the second chamber 16 and the sponge 20 will be exhausted. After the top surface 28 of the lid 21 of ink cartridge is covered and sealed thermally with a membrane 23, the outer mouths of the through holes 24 and 25 will be closed by the membrane 23; the through hole 25 and a portion of the maze groove 22 will also be sealed by the membrane 23. The maze groove 22 sealed with the membrane 23 forms into a maze passage 27. The storage chamber 15 of the ink cartridge 11 is in communication with the atmosphere through the very fine passage of the maze passage 27. The sponge 20 in the storage chamber 15 can provide an effect of absorbing ink and balancing the pressure in the storage chamber 15. Before the ink cartridge 11 is used, the maze passage 27 on the top surface 28 of the ink cartridge 11 would not cause the ink to leak out through the maze passage 27. When the ink cartridge 11 is connected with the printer, the isolation film 18 sealed on the output port 29 will be stabbed through by the ink straw of the connecting seat. After the hermetic gasket 17 of the output port 29 on the ink cartridge 11 is connected hermetically with the ink straw of the connecting seat, the ink absorbed in the sponge 20 of the storage chamber 15 will be reduced as the printer is working until the sponge 20 is unable to supply ink through the mesh 19 to enter the second chamber 16; then, a new ink cartridge may be mounted in place for supplying ink to the printer.

It has been found that when the storage chamber 15 of the ink cartridge 11 is replenished with ink, air will enter the second chamber 16 as a result of the isolation film 18 on the output port 29 being broken and the connecting seat of the printer being separated therefrom. After replenishing ink, the end opening of the output port 29 should be sealed again with a glue paper 47 around the isolation film 18. In order to seal the out put port 29 firmly, a clamp may be used for fastening and sealing the output port 29 during ink replenishing.

According to the conventional way of refilling ink, a syringe filled with given quantity of ink, and then the needle of syringe stabs the membrance 26 on the through hole 24 so as to have the ink injected into the sponge 20 in the storage chamber 15; however, air contained in the sponge 20 and in the second chamber 16 is unable to exhaust, i.e., the ink-replenishing operation can not be done completely.

The ink is usually replenished when the printing of the ink cartridge is poor, i.e., the second chamber 16 of the ink cartridge 11 fails to convey ink through a connecting tube to the storage chamber of the sprayer because that the ink injected into the storage chamber 15 by using the needle of syringe will be blockaded by the meshes 19; the air in the second chamber 16 is not exhausted, and therefore the ink is unable to flow into the second chamber 16; in other words, the ink replenished in the storage chamber 15 is unable to be supplied to the printer.

Figure 8:
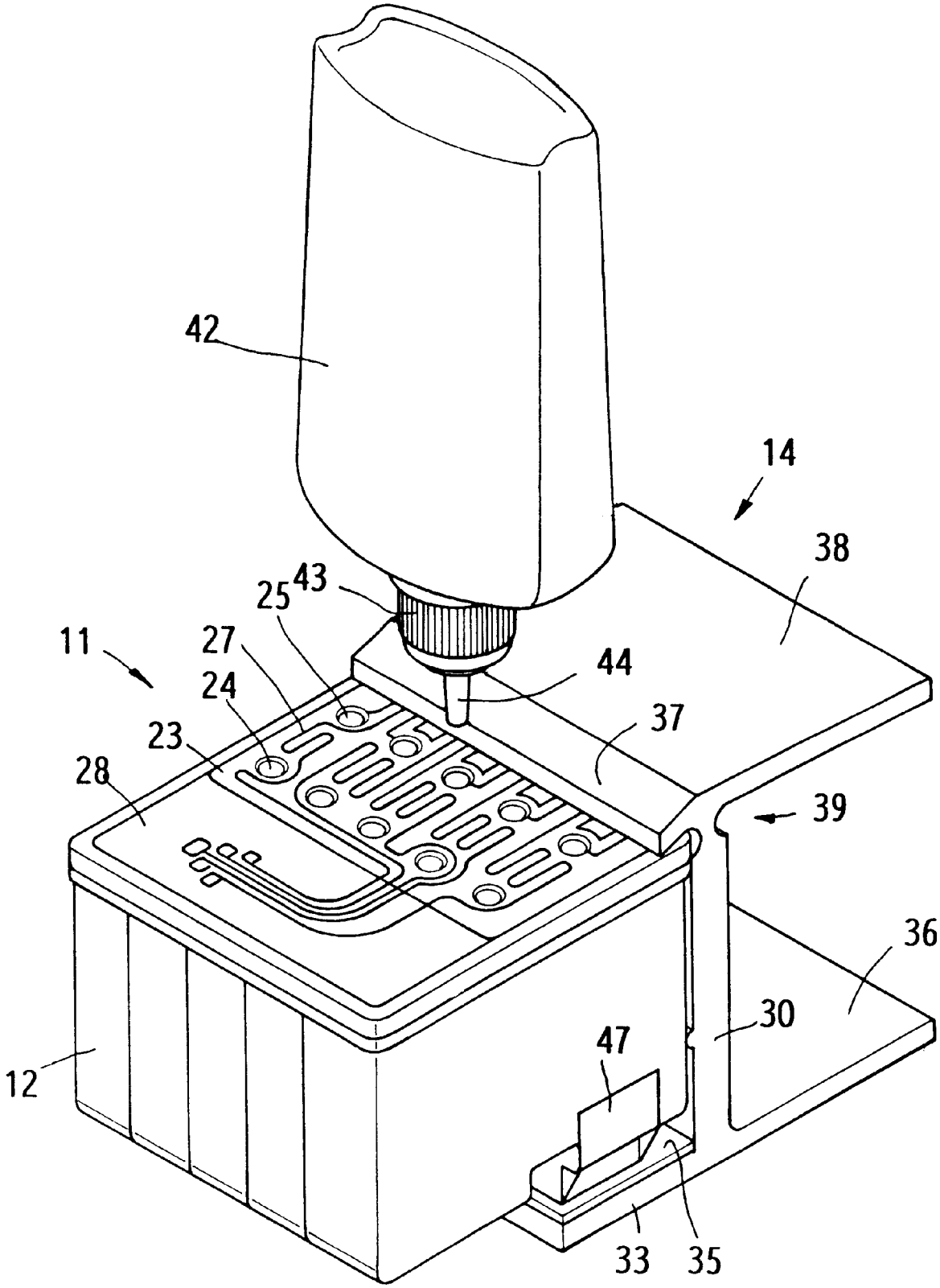
FIG. 8 is a perspective view of the present invention, showing the connection and refillng condition between the ink bottle and the through hole of the ink cartridge.

Referring to FIGS. 1, 2 and 8, this invention relates to an ink-replenishing device for ink cartridge of a jet printer, of which the feature is that the outer end of the output port 29 of the second chamber 16 is first sealed with a glue paper 47 after ink in the cartridge 11 is used up; then, the pressing plate 38 of a protection clamp 14 is mounted over the end opening of the output port 29 of ink cartridge 11 so as to prevent the ink from leaking out of the output port 29, and the end opening of the output port 29 will be sealed with the glue paper 47 by means of a pressing force. After the ink cartridge 11 is clamped in place, the taper-shaped ink straw 44 is used to stab the membrane 48 on the through hole 25, which is in communication with the top surface 28 and the maze passage 27; the ink straw 44 and the through hole 25 are closely connected together. The ink bottle 13 is compressed repeatedly so as to let ink exchange with the air in the storage chamber 15 quickly. After the ink is filled into the storage chamber 15 of the ink cartridge 11, air in the second chamber 16 and the sponge 20 will be exhausted.

Referring to FIGS. 2 to 6, the present invention can prevent the output port 29 in the ink cartridge 11 from leaking ink upon the ink cartridge 11 being replenished; after the output port 29 is attached with the glue paper 47, one side of the ink cartridge 11 will be embedded in a clamp space 40 between the supporting plate 33 and the clamp plate 37 upon the pressing surface 32 being pressed down; then, a resilient pad 35 on the inner surface 34 of the supporting plate 33 will be in close contact with the end opening of the output port 29 of the ink cartridge hermetically.

The protection clamp 14 for holding the end opening of the output port 29 of the ink cartridge 11 is a similar to I-shaped clamp, which includes a vertical plate 30 having a suitable height, two supporting plates 33 and 36 on both sides of the lower part of the vertical plate 30 respectively, a clamp plate 37 on one side of the upper end of the vertical plate 30, and a pressing plate 38 on other side of the upper end of the vertical plate 30. A neck portion 39 is furnished between the upper end of the vertical plate 30 and the plates 37 and 38, As soon as the pressing surface 32 is pushed downwards, the distance between the clamp plate 37 and the supporting plate 33 will be increased.

The protection clamp 14 provides the ink cartridge 11 with a clamp space 40, which includes the supporting plate 33, the vertical plate 30 and the clamp plate 37. The inner surface 34 of the supporting plate 33 is glued with a resilient pad 35. One side of the vertical plate 30 is furnished with a positioning horizontal flange 41, which is used for fitting the projected part of the lid 21 of the ink cartridge 11, i.e., to facilitate two flat surfaces contacted in parallel and hermetically between the output port 29 and the resilient pad 35 on the inner surface 34 after the ink cartridge 11 being held in the clamp space 40 of the protection clamp 14. The clamp plate 37 extends out of the neck portion 39 in a slightly downward fashion. The clamp plate 37 and the pressing plate 38 are formed into one piece, and when the pressing plate 38 is pushed downwards, the clamp plate 37 will be lifted upwards so as to augment the height of the clamp space 40 in order to push the ink cartridge 11 therein easily.

The lower end of the vertical plate 30 is furnished with two supporting plates 33 and 36 on both sides thereof, having suitable lengths respectively. The length of the supporting plate 33 is so designed to fit the width of the outer surface of the output port 29 so as to enable the end opening of the output port 29 and the resilient pad 35 on the inner surface 34 to contact hermetically. The supporting plate 36 extended to other side of the vertical plate 30 is longer than the plate 33. The pressing plate 38 furnished on one upper side of the vertical plate has a length corresponding to that of the supporting plate 36. The elongate supporting plate 36 and pressing plate 38 enable an operating person to hold and press the plate 38; since the neck portion 39 is slightly resilient, the clamp plate 37 can be lifted upwards slightly so as to increase the height of the clamp space 40 to facilitate the ink cartridge 11 being inserted therein; after the pressing plate 38 is released, it will restore to its original position. As soon as the ink cartridge 11 is inserted into the clamp space 40, the ink cartridge 11 will be held in place by means of the clamp plate 37 and the supporting plate 33; simultaneously, the resilient pad 35 on the inner surface 34 of the supporting plate 33 will be in close and hermetic contact with the end opening of the output port 29, and therefore the hermetic contact between the glue paper 47 and the end opening of the output port 29 will also be increased considerably.

Figure 6:
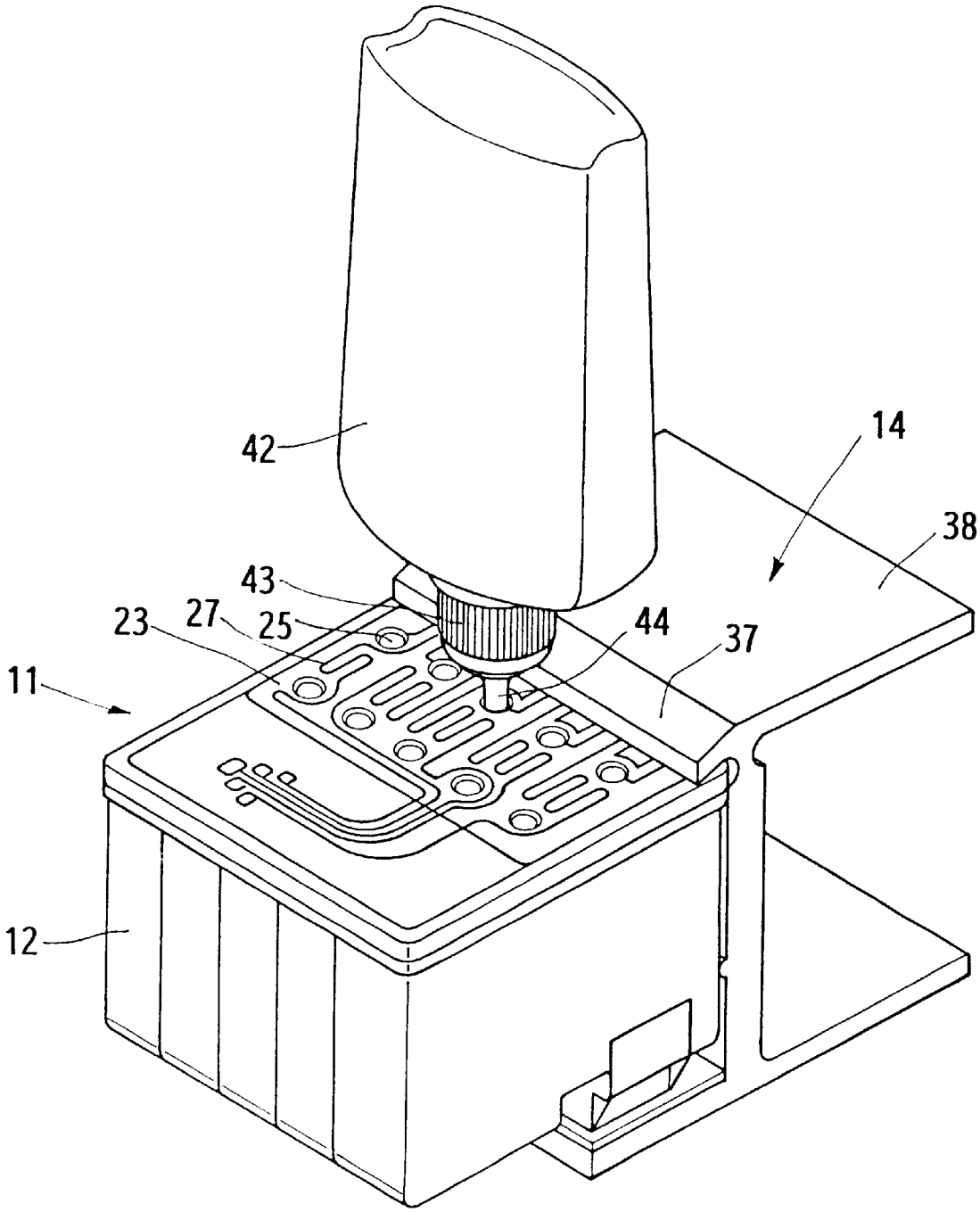
FIG. 6 is a perspective view of the present invention, showing the clamping condition between the ink cartridge and the protection clamp.
Figure 7:
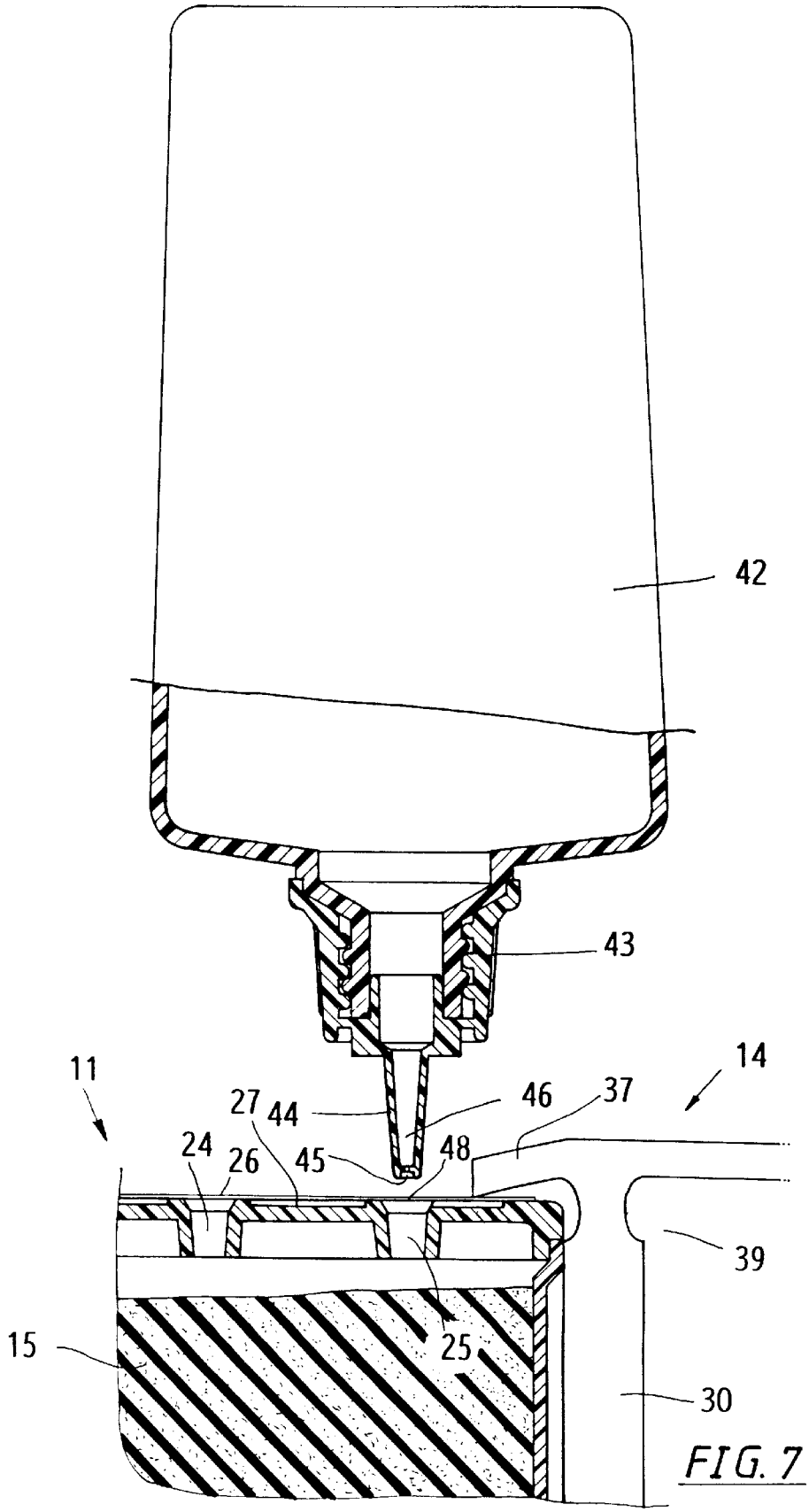
FIG. 7 is a sectional view of the present invention, showing the structure relation between the ink straw of the ink bottle and the lid of the ink cartridge.
Figure 9:
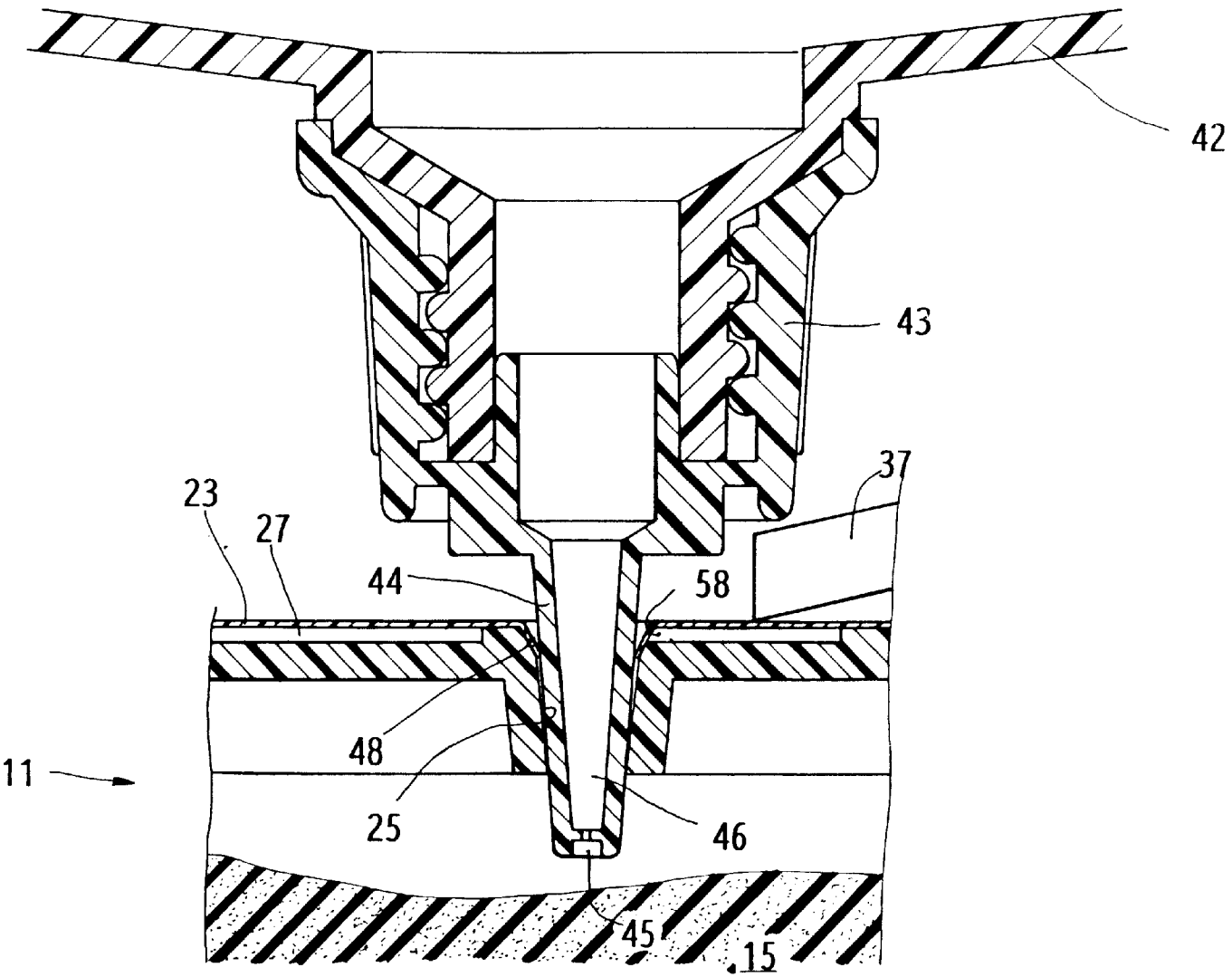
FIG. 9 is a sectional view of the present invention, showing connection and refilling condition between the ink bottle and the through hole of the ink cartridge.

Referring to FIGS. 2, 6 and 9, the two through holes 24 and 25 on the storage chambers 15 have been sealed with membrane 23 upon the ink cartridge 11 being clamped in the protection clamp 14. In the aforesaid description, the structure and features of the top surface 28 of the ink cartridge 11 have been disclosed. When refilling ink, an ink bottle 42 can be selected in accordance with the color of the storage chamber 15; the taper-shaped ink straw 44 of the bottle cap 43 of the ink bottle 42 can be used to stab through the membrane 48 on the through hole 25 of the maze passage 27 directly so as to replenish ink therein.

The ink bottle 42 includes and the bottle cap 43; the bottle 42 is substantially a conventional bottle shape for loading ink, and the quantity thereof may be classified in accordance with the quantity in real use. Both the bottle cap 43 and the mouth of bottle 42 are furnished with threads so as to have them connected together, and the structure thereof is the same as that of a conventional bottle except for a short taper-shaped ink straw 44 on the front of the bottle cap 43. The taper-shaped part of the ink straw 44 is designed to fit the diameter of the through hole 25 in the ink cartridge 11, but it is slightly less than the diameter of the through hole 25 so as to let the ink straw 44 plug through the through hole 25; one end part 45 of the ink straw 44 extends into the storage chamber 15.

After the bottle 42 and the bottle cap 43 are screwed together, the end part 45 of the ink straw 44 on the front part of the bottle cap 43 is in closed condition before being used. In real use, there are two methods to be followed, i.e., one method is to let the end part 45 of the sealed tip of ink straw 44 stab through the membrane 48 on the through hole 25, and then remove the ink bottle 42 to stab through the sealed tip with needle; another method is to stab through the sealed tip of the ink straw 44 first with a needle, and then put the bottle cap 43 of ink bottle 42 upside down to point at the through hole 25 of the ink cartridge 10. During the ink bottle 42 moving, the ink in the bottle 42 would not flow out of the stabbed hole on the ink straw 44 unless the bottle 42 is compressed. As soon as the end part 45 of the ink straw 44 is in contact with the membrane 48 of the through hole 25 on the top surface 28 of ink cartridge 11, it is pushed with force so as to let the end part 45 stab through the membrane 48. After the end part 45 of the ink straw 44 contacts with the through hole 25, the end part 45 should be pushed downwards until the ink straw 44 is in close and hermetic contact with the inner surface of the through hole 25; in that case, the membrane 48 on the through hole 25 will be pushed into the through hole 25 by the ink straw 44, i.e., being detained between the end part of the through hole 25 and inner surface of the ink straw 44. Since the membrane 48 is resilient, it will cause the ink straw 44 and the through hole 25 to have a second hermetic seal.

During the replenishing operation for the ink cartridge 11, the output port 29 of the ink cartridge 11 has been sealed by the protection clamp 14; then, the ink bottle 42 connected together with the through holes 25 can be compressed to cause ink therein to flow into the storage chamber 15 of the ink cartridge 11. When the ink straw 44 of the ink bottle 42 and the through hole 25 of the ink cartridge 11 are connected together, the maze passage 27 furnished on the top surface of the ink cartridge 11 will become useless temporarily because of being covered and sealed completely. After the output port 29 of the ink cartridge 11 is clamped and sealed with the protection clamp 14, the storage chamber 15 and the ink bottle 13 form into a convection space. When the ink bottle 13 is squeezed, the ink will be injected into the storage chamber 15. When the ink bottle 13 is released, the air in the storage chamber 15 and the second chamber 16 will be sucked out as a result of the resilient restoring effect of the bottle 42 to provide a vacuum pumping force. Squeeze and release the bottle several times until the ink bottle 42 is unable to be compressed any further; then, separate the ink straw 44 of the ink bottle 42 from the through hole 25 of the ink cartridge 11; attach a glue paper 47 to the outer surface of the through hole 25 of the ink cartridge 11, and then the replenishing operation is done.

After the through hole 25 on top of the storage chamber 15 is covered and sealed with the membrane 23, a maze passage 27 is formed, being in communication with the atmosphere; such a fine passage is used for balancing the pressure inside the storage chamber 15. During the ink being consumed by the printer, a tiny quantity of air will enter the storage chamber 15 of the ink cartridge 11 so as to provide the printer with a normal quantity of ink.

The membrane 48 sealed over the through hole 25 on the storage chamber 15 has been stabbed through with the ink straw 44 of the ink bottle 13 upon ink-replenishing operation, and the membrane 48 stabbed will be pushed and squeezed by the ink straw 44; as a result, the end opening between the maze groove 22 and the through hole 25 will be closed. When the ink straw 44 of the ink bottle 13 is separated from the through hole 25 of the ink cartridge 11, the membrane 48 pushed into the end opening 31 of the through hole 25 will cause the end opening between the maze groove 22 and the through hole 25 to open again, i.e., to restore the original function thereof. In the event of the membrane 48 not being pulled back to the end opening upon the ink straw 44 being separated from the through hole 25 of the ink cartridge 11, the end opening of the through hole 25 is closed with the membrane 48 and the maze passage 27 is unable to restore its original function. In that case, the maze passage 27 can be restored to its original function as soon as the ink cartridge 11 is mounted to the jet printer for normal printing operation, and the ink in the storage chamber 15 is used up, and then the storage chamber 15 will generate a vacuum-pumping force to pull the membrane 48 on the end opening of through hole 25 and the maze groove 22 backwards.

According to the aforesaid embodiment, the prime consideration of the present invention is aimed at the sponge 20 in the ink cartridge 11. The end opening of the output port 29 of the ink cartridge 11 is held and protected with the protection clamp 14. During replenishing operation, the taper-shaped ink straw 44 of the ink bottle 42 will stab through the through hole 25 of the maze passage 27 so as to close all the outward passage of the storage chamber 15 in the ink cartridge 11. When the ink bottle 42 is squeezed, the ink will quickly flow, through ink passage 46, into the sponge 20 in the ink cartridge 11; as soon as the ink bottle 42 is released, the restoring force of the bottle 42 will generate a vacuum-pumping force to suck the air in the storage chamber 15 into the ink bottle 13, i.e., the air sucked will flow through the fine and short ink passage 46 and into the ink bottle. During the repeated squeezing operation, the ink and air will have a rapid convection through the ink straw 44 so as to prevent air sucked out from flowing into the storage chamber 15 again to affect the replenishing operation.

The short taper-shaped ink straw 44 of the ink bottle 42 has a fine and short ink passage 46, which is deemed a prime feature of the present invention. If the ink straw 44 is too long, the air in the storage chamber 15 sucked into the ink passage 46 is unable to flow into the upper part of the bottle 42, and it will enter the sponge 20 again during the repeated squeezing operation; the air and ink together entered the sponge 20 have a jet force, which would cause the sponge 20 to generate more air bubbles to affect the replenishing operation.

Figure 10:
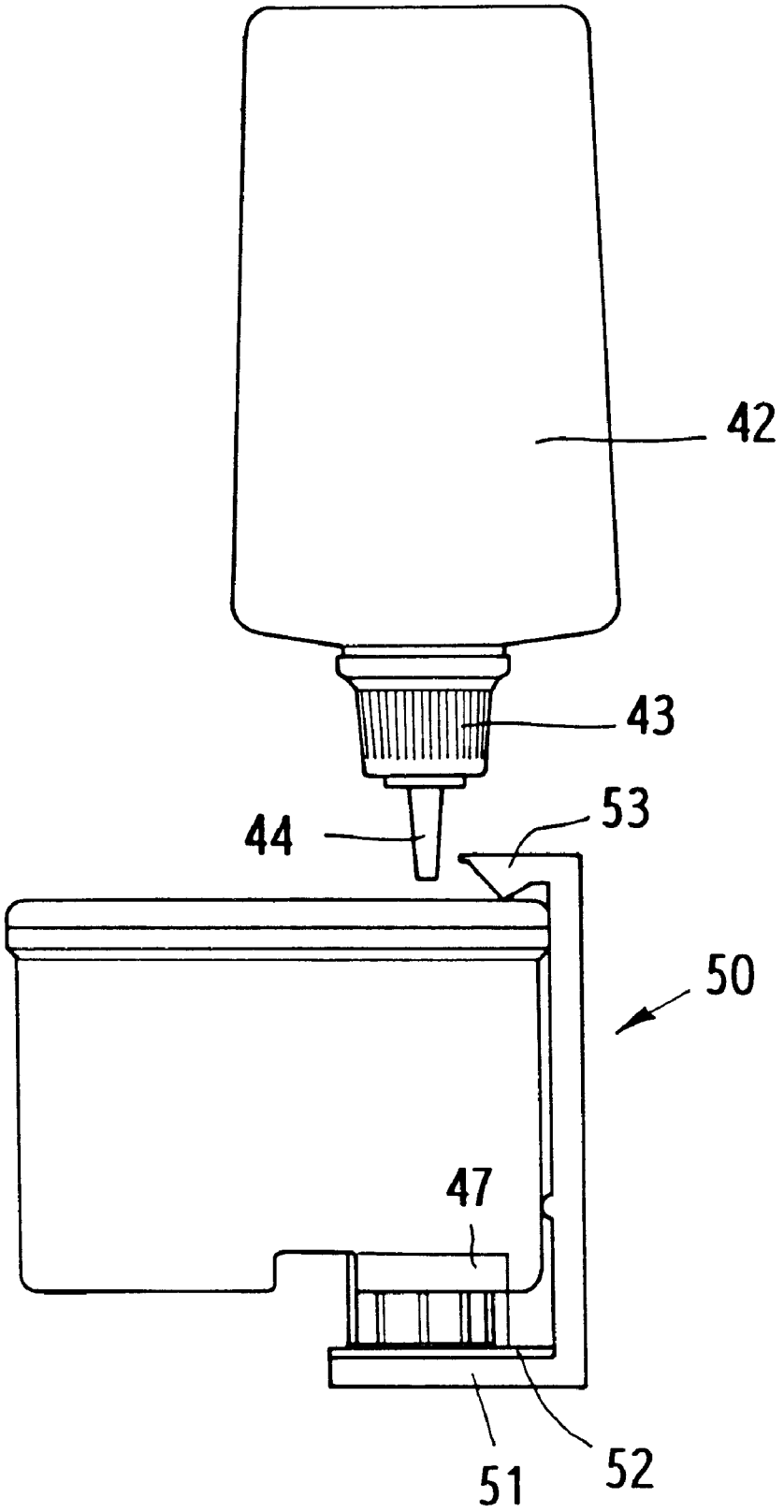
FIG. 10 is a sectional view of the present invention, showing the ink cartridge being clamped by means of a conventional clamp structure.

In addition to the protection clamp 14 for clamping the output port 29 for replenishing operation, a conventional C-shaped clamp 50 as shown in FIG. 10 may be used for gripping the ink cartridge 11; the lower support plate 51 of the C-shaped clamp 50 has a resilient pad 52 on the inner surface thereof, while the upper support plate 53 is a short one. After the ink cartridge 11 is gripped in the C-shaped clamp 50, the resilient pad 52 of the lower support plate 51 can prevent the output port from leaking ink. Although the conventional C-shaped clamp 50 has drawbacks, it is still useful to seal the output port 29 of the ink cartridge 11.

Figure 11:
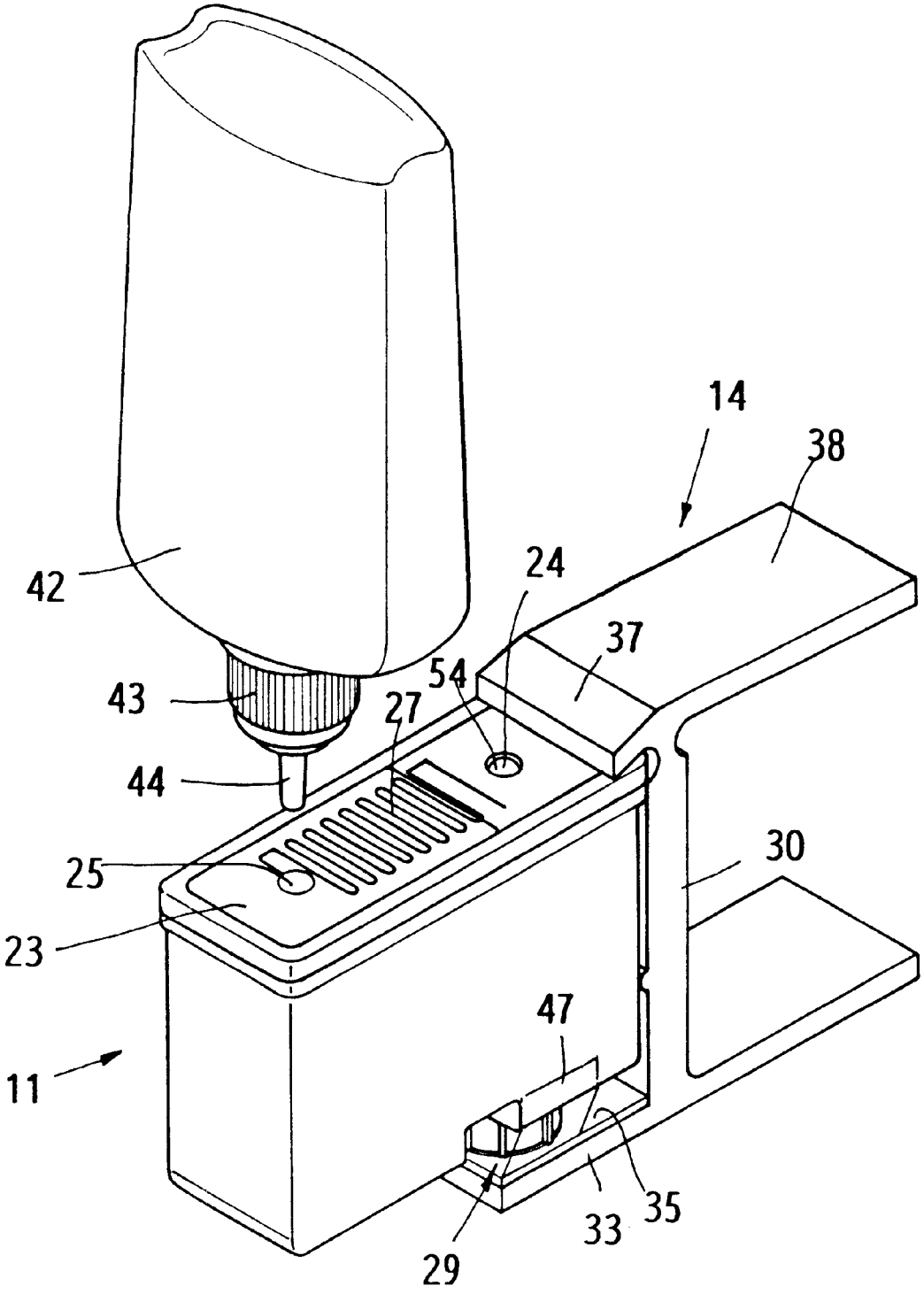
FIG. 11 and 12 are perspective views, showing the shape of the ink cartridge and the condition of refilling ink respectively.

Referring to FIG. 11, the storage chamber 15 of the ink cartridge 11 uses a sponge to store up ink. The top surface of the ink cartridge 11 is furnished with two through holes 24 and 25; the through hole 25 is in communication with the maze groove 22. After the two through holes 24 and 25 are replenished with ink, the outer surface of the through hole 25 and the maze groove 22 will be attached with a membrane 23 to form into a maze passage 27; the through hole 24 is closed with a round ball 54. The maze passage 27 is used for balancing the supply of ink in the sponge. To replenish ink, a protection clamp 14 is used first to grip the output port of the ink cartridge 11; then, put the end part 45 of the ink straw 44 on the ink bottle 42 towards the membrane 48 on the through hole 25, and stab through the membrane 48 so as to have it become in close contact with the end part of the through hole 25, and to have the ink in the ink bottle 42 injected into the storage chamber of the ink cartridge 11.

Figure 12:
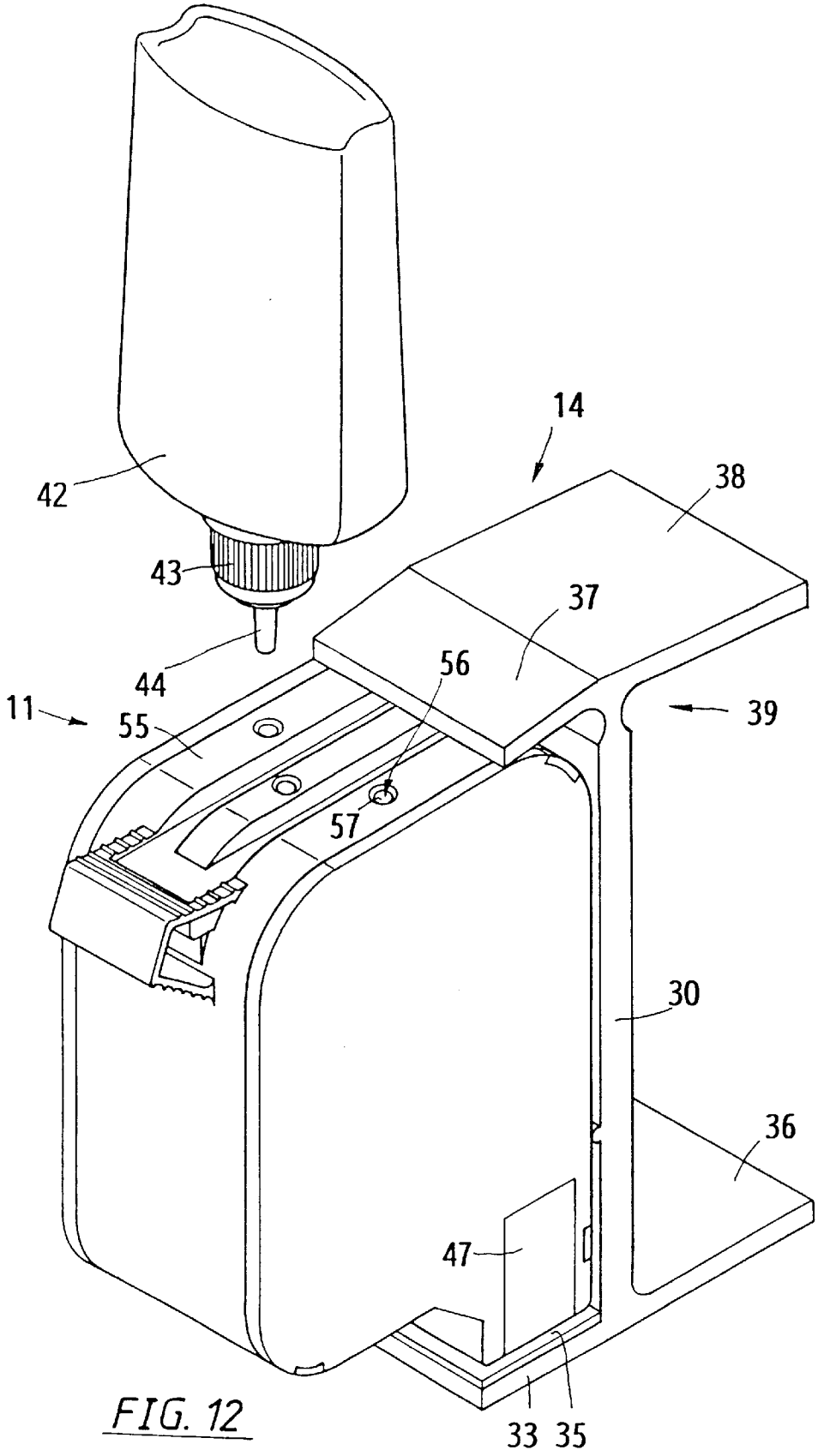

Referring to FIG. 12, the output port 29 of the ink cartridge 11 is furnished with an elector-controlled printing head; the storage chamber 15 of the ink cartridge 11 uses a sponge for storing ink. The top surface 55 of the ink cartridge 11 is furnished with several through holes 56 in accordance with the number of the isolated storage chambers. The ink cartridge 11 can be replenished via the through hole 56, which will be closed with a round ball 57 after replenishing operation. For replenishing operation, the output port of the ink cartridge 11 should be gripped by means of the protection clamp 14 first; use the ink straw 44 of the ink bottle 42 to push the round ball 57 into the storage chamber so as to have the ink straw 44 closely connected together with the through hole 56 to facilitate ink to inject into the storage chamber. After replenishing operation is done, the outer edge of the through hole 56 will be sealed with a glue paper.

According to the method and technique of the present invention, the short taper-shaped ink straw 44 on the ink bottle 42 is used to stab the membrane on the through hole of the maze passage, or to push the round ball in the through hole of the ink cartridge so as to have the ink straw 44 closely connected with the through hole of the ink cartridge, and to have ink and air exchanged rapidly by means of the ink straw 44, and finally the ink will be injected into the storage chamber of the ink cartridge; simultaneously, the bubbles and air in the sponge and the second chamber will be exhausted. By means of the aforesaid embodiments, the structure and features between the ink straw and the through hole of the ink cartridge have been disclosed completely; it is apparent that the present invention has provided apparent improvement and innovation, and fulfilled the objects as expected; such features are never anticipated and achieved by any person skilled in the field.

What is claimed is:

1. An ink replenishing apparatus for an ink cartridge of a jet printer, the ink cartridge having an ink storage chamber containing a sponge for soaking up ink, a second chamber communicating with the ink storage chamber and an open output port located in a bottom of the ink cartridge in communication with the second chamber, the apparatus comprising:

a) at least one through hole through a top of the ink cartridge, the at least one through hole communicating with the ink storage chamber and having a tapered configuration in which a diameter decreases in a direction toward the ink storage chamber;

b) a clamping device for holding the ink cartridge during replenishing, the clamping device having a supporting plate with a resilient pad covering the output port so as to hermetically seal the output port, and a movable clamp plate engaging the top of the ink cartridge whereby the ink cartridge is clamped between the supporting plate and the clamp plate; and c) a squeezable ink supply bottle having a tapered ink-straw with an ink passage therethrough, the ink-straw having a tapered external surface matching the tapered configuration of the at least one through hole such that the ink-straw hermetically seals the at least one through hole when a distal end of the ink-straw extends into the ink storage chamber, whereby repeated squeezing of the ink bottle injects ink into the ink cartridge and removes air therefrom.

2. The ink replenishing apparatus of claim 1 further comprising a maze groove in the top of the ink cartridge in communication with the at least one through hole.

3. The ink replenishing apparatus of claim 1 wherein the clamping device further comprises a plate member connecting the supporting plate and the clamp plate.

4. The ink replenishing apparatus of claim 3 wherein a thickness of the plate member is reduced at a junction between the plate member and the clamp plate to facilitate movement of the clamp plate relative to the supporting plate.

5. The ink replenishing apparatus of claim 4 further comprising a pressing plate extending from the clamp plate to facilitate the movement of the clamp plate.

6. The ink replenishing apparatus of claim 5 wherein the clamp device has an I-shaped configuration.

* * * * *